US011987982B2

(12) United States Patent
Hormay et al.

(10) Patent No.: US 11,987,982 B2
(45) Date of Patent: May 21, 2024

(54) STRUCTURAL SUPPORT SYSTEM FOR ROCKWORK WITH MECHANICAL FASTENING OF ADJACENT CHIP ASSEMBLIES

(71) Applicant: Disney Enterprises, Inc., Burbank, CA (US)

(72) Inventors: Zsolt Hormay, Tokyo (JP); Philip J. Jackson, Glendale, CA (US); Tammy Tosounian, Altadena, CA (US); Robert W. Jewell, Winter Garden, FL (US); Angela M. Orovets, Los Angeles, CA (US); Robert Pontrelli, Glendale, CA (US); Maeis Heshmati, Tujunga, CA (US)

(73) Assignee: Disney Enterprises, Inc., Burbank, CA (US)

( * ) Notice: Subject to any disclaimer, the term of this patent is extended or adjusted under 35 U.S.C. 154(b) by 27 days.

(21) Appl. No.: 17/541,001

(22) Filed: Dec. 2, 2021

(65) Prior Publication Data

US 2023/0175261 A1 Jun. 8, 2023

(51) Int. Cl.
*E04C 5/16* (2006.01)
*E04C 5/18* (2006.01)
(Continued)

(52) U.S. Cl.
CPC ..... *E04C 5/163* (2013.01); *E04C 5/16* (2013.01); *E04C 5/167* (2013.01); *E04C 5/168* (2013.01);
(Continued)

(58) Field of Classification Search
CPC . E04C 5/16; E04C 5/163; E04C 5/167; E04C 5/168; E04C 5/18; E04G 21/122; E04F 13/047
See application file for complete search history.

(56) References Cited

U.S. PATENT DOCUMENTS 910,399 A * 1/1909 Lidseen ..... E04C 5/168 52/686
1,149,648 A * 8/1915 Henderson ..... E04C 5/167 52/719
(Continued)

FOREIGN PATENT DOCUMENTS

CA 2589974 A1 * 12/2008 ..... E04C 5/163
EP 476812 A * 3/1992 ..... E04C 5/168
(Continued)

OTHER PUBLICATIONS

Extended European Search Report for European Patent Application No. 22193521.6, dated Apr. 25, 2023, 7 pages.

*Primary Examiner* — Jessie T Fonseca
(74) *Attorney, Agent, or Firm* — Dorsey & Whitney LLP

(57) ABSTRACT

Rebar-based support assemblies that can be fabricated without the need for on-site welding. The assemblies include a number of differing sized and shaped crimps used in place of welds to provide rebar assembly-to-rebar assembly connections. Each crimp mechanically couples two or three pieces of rebar together, such as a border bar of one rebar assembly to a border bar of an adjacent rebar assembly. Each crimp includes a body with two or more arcuate recessed surfaces each for receiving a piece of rebar. In a first configuration of the crimp, a pair of spaced-apart arms (or extending members) extend from the body and define an opening through which the rebar is passed and set into the recessed surfaces. A deformation force is applied upon the two arms to deform the body into a second configuration with the arms in abutting contact or nearly so at an outer tip or end.

15 Claims, 6 Drawing Sheets

(51) Int. Cl.
*E04G 21/12* (2006.01)
*E04F 13/04* (2006.01)

(52) U.S. Cl.
CPC ..... *E04C 5/18* (2013.01); *E04G 21/122* (2013.01); *E04F 13/047* (2013.01)

(56) References Cited

U.S. PATENT DOCUMENTS

| | | | | | |
|---|---|---|---|---|---|
| 4,110,951 | A * | 9/1978 | Padrun | E04C 5/168 | 403/395 |
| 4,617,775 | A * | 10/1986 | Padrun | E04C 5/163 | 403/397 |
| 4,835,934 | A * | 6/1989 | Swenson | E04C 5/18 | 52/DIG. 1 |
| 4,991,372 | A | 2/1991 | Sonneville | | |
| 6,231,024 | B1 * | 5/2001 | Kugimiya | E04G 17/06 | 249/33 |
| 7,143,563 | B1 * | 12/2006 | Palmer | E04C 5/18 | 52/712 |
| 2005/0133684 | A1 * | 6/2005 | Maguire | E04C 5/16 | 249/91 |
| 2008/0271409 | A1 * | 11/2008 | Kodi | E04C 5/20 | 52/745.21 |
| 2014/0308474 | A1 * | 10/2014 | Subacchi | E04C 5/168 | 428/81 |
| 2016/0108620 | A1 * | 4/2016 | Yi | E04C 5/16 | 52/687 |

FOREIGN PATENT DOCUMENTS

| | | | | |
|---|---|---|---|---|
| GB | 2398332 | A * | 8/2004 | E02D 5/72 |
| KR | 200478953 | Y1 * | 12/2015 | |

* cited by examiner

STRUCTURAL SUPPORT SYSTEM FOR ROCKWORK WITH MECHANICAL FASTENING OF ADJACENT CHIP ASSEMBLIES

BACKGROUND

1. Field of the Description

The present description relates, in general, to fabrication of physical structures formed with underlying or integral structural support systems or networks of rebar over which foam, concrete, plaster, shotcrete, or other material may be applied or installed. These architectural or physical structures may include outdoor and indoor scenery structures (or "rockwork") that may be used in rides and attractions for use in amusement parks and theme parks or that may be used at malls, city parks, and other settings. More particularly, the present description relates to a structural support system or network for such physical structures that is designed to replace welded joints with mechanical fastening to join adjacent chip assemblies (i.e., sections or mesh panels formed of bent and joined lengths or pieces of rebar (or pieces of rods or bars typically formed of a metal such as a steel)).

2. Relevant Background

Rebar (or reinforcing bar), which is typically formed of steel, is used widely as a tension device in architectural or physical structures to reinforce the main structural material such as to provide reinforced masonry, concrete, and other material structures. The rebar is used to strengthen the material in which it is embedded then this material is under tension. For example, concrete and many other structural materials are strong under compression but relatively weak under tension, and the rebar significantly increases the tensile strength of the fabricated structures. The most common type of rebar is formed of carbon steel, but other readily available types include stainless steel that may be used when corrosion resistance is desirable.

While being very useful in providing a shaping and reinforcing underlayer, rebar systems can be labor intensive to fabricate and install. For example, theme and amusement park operators presently build large architectural features throughout the parks to replicate physical structures or rockwork to replicate scenery and outdoor or indoor environments suited to the ride or attraction. The rockwork is typically fabricated with an underlayer or support structure formed of a network or system of rebar assemblies or chips, with each of these rebar assemblies or chips being made up of a mesh or plurality of crisscrossing pieces or lengths of rebar. To provide the unique shape of rocks and structures found in nature, the rebar may be bent such that the chips may be nonplanar. Each rebar assembly may include a border formed of pieces of rebar ("border bars") and pieces of infill bars extending between the border bars.

In fabricating the physical structure, all of the rebar assemblies or chips are properly positioned on site and then joined together to form the support structure or system for the physical structure, which is then completed by applying one or more layers of material such as plaster, cement mix, concrete, foam, or the like over the rebar assemblies. Presently, the joining of all these rebar assemblies is welding intensive, which can be a labor intensive process, can involve compliance with a variety of environmental and safety procedures, and, as a result, can add significant time to the overall construction of a structure or rockwork. Each chip or rebar assembly may be relatively large, such as 6 to 8-foot on a side of a generally square chip, and numerous welds may be used along each side or length of border to join adjacent chips or rebar assembly. For example, conventional construction practices may use a chip-to-chip connection around the entire perimeter of each chip in a structural support system that includes a 2-inch long weld every 6 inches. With the use of hundreds of chips or rebar assemblies in each rockwork or physical structure being fabricated, this can lead to thousands of welds being used to join together mating pieces of rebar.

SUMMARY

The inventors recognized that there was a need for rebar-based support assemblies that can be fabricated without the need for (or at least a reduced need for) on-site welding. To this end, the inventors designed a number of differing sized and shaped crimps (or pieces of join hardware) that can used in place of welds to provide rebar assembly-to-rebar assembly (or chip-to-chip) connections. Each crimp can be used to mechanically couple or attach two or three pieces of rebar together, such as a border bar of one chip to a border bar of an adjacent chip in the structural support system or network.

In place of welding, each crimp includes a body with two or more arcuate recessed surfaces each for receiving a piece of rebar. In a first configuration of the crimp (or prior to deformation), a pair of spaced-apart arms (or extending members) extend from the body and define an opening through which the pieces of rebar may be passed and set into the recessed surfaces. With the two or three pieces of rebar in the recessed surfaces, a deformation force is applied in an inward direction upon outer surfaces of the two arms to deform the body into a second configuration with the arms in abutting contact at an outer tip or end (or nearly in contact). This movement of the arms may be achieved with a hydraulic crimper or similar tool applying the deformation force, e.g., 6 to 12 tons of force as may be provided by a hydraulic crimper with a C-head or similar tool. With the crimp in the second configuration, the two or three pieces of rebar abut the recessed surfaces of the body and are typically held in place in the body such that the rebar pieces are mechanically joined together such that the rebar pieces are restrained from moving along or transverse to their longitudinal axes by the deformed crimp (or crimp in the second configuration).

More particularly, a structural support system or network is provided for use in fabricating a physical structure such as rockwork for a theme park or other setting. The system includes a plurality of rebar assemblies. Each of the rebar assemblies includes a first set of pieces of rebar extending about an exterior border and a second set of pieces of rebar arranged in a crisscross pattern to infill a space within the exterior border. The system also includes a plurality of two-bar crimps interconnecting adjacent pairs of the plurality of the rebar assemblies. Each of the two-bar crimps receives a piece of rebar from the first set of pieces of rebar from each of the adjacent pairs and retains the two received pieces of rebar in abutting contact.

In some embodiments, each of two-bar crimps includes a body with a pair of recessed surfaces configured for receiving the two received pieces of rebar and with a pair of spaced apart arms encircling the two received pieces of rebar. The body is reconfigurable via plastic deformation under a deforming force from a first configuration, in which tips of the spaced apart arms define an opening greater than an outer diameter of each of the two received pieces of rebar to provide access to the pair of recessed surfaces, to a second configuration, in which the opening is less than the outer diameter of each of the two received pieces of rebar. The deforming force can be in the range of 6 to 12 tons (e.g., 10 to 12 tons), and the body is formed of a steel. The steel may be carbon steel with a hardness in the range of 60 to 75 HRB or may be a stainless steel with a hardness less than about 90 HRB.

In some embodiments, the system may further include a plurality of reinforcing bars and a plurality of 3-bar crimps mechanically coupling the reinforcing bars to the border bars of a set of the adjacent pairs of the plurality of the rebar assemblies. In such cases, each of the three-bar crimps may include a body with three recessed surfaces configured for receiving one of the reinforcing bars and two pieces of rebar from the first set of pieces of the rebar and with a pair of spaced apart arms encircling one of the reinforcing bars and the two pieces of the rebar. The body of the three-bar crimp is reconfigurable via plastic deformation under a deforming force from a first configuration, in which tips of the spaced apart arms define an opening greater than an outer diameter of each of one of the reinforcing bars and the two pieces of the rebar to provide access to the recessed surfaces, to a second configuration, in which the opening is reduced in size and the one of the reinforcing bars and the two pieces of the rebar are retained in abutting contact. In some implementations, the deforming force is in the range of 6 to 12 tons, with the body being formed of a carbon steel in the range of 60 to 75 HRB or of a stainless steel with a hardness less than about 90 HRB.

DETAILED DESCRIPTION OF THE PREFERRED EMBODIMENTS

Briefly, the following description describes physical structures, such as rockwork for theme parks and the like, that can be fabricated with an underlying structural support system or network. The support system or network is fabricated from a plurality of interconnected or joined rebar assemblies or panels (also call "chips" herein), which each are formed of a plurality of pieces or lengths of rebar that are shaped or bent and joined together such that when all the rebar assemblies or panels are interconnected the support system or network defines a skeleton of the physical structure. The physical structure may then be completed by applying one or more layers of material, such as plaster, cement, concrete, foam, or the like, over the support system or network.

Significantly, adjacent rebar assemblies or panels are interconnected or physically joined together through the use of mechanical hardware rather than welding. Particularly, newly designed crimps (e.g., 2-bar crimps) are used to join or couple border bars (i.e., pieces of rebar along an outer perimeter or border) of the adjacent rebar assemblies together in place of numerous welds. Additionally, crimps (e.g., 3-bar crimps) are used to affix pieces of rebar that are used for reinforcement in place of welding by coupling two infill bars (i.e., pieces of rebar extending between border bars in a rebar assembly or chip) to an additional piece of rebar.

Figure 1B:
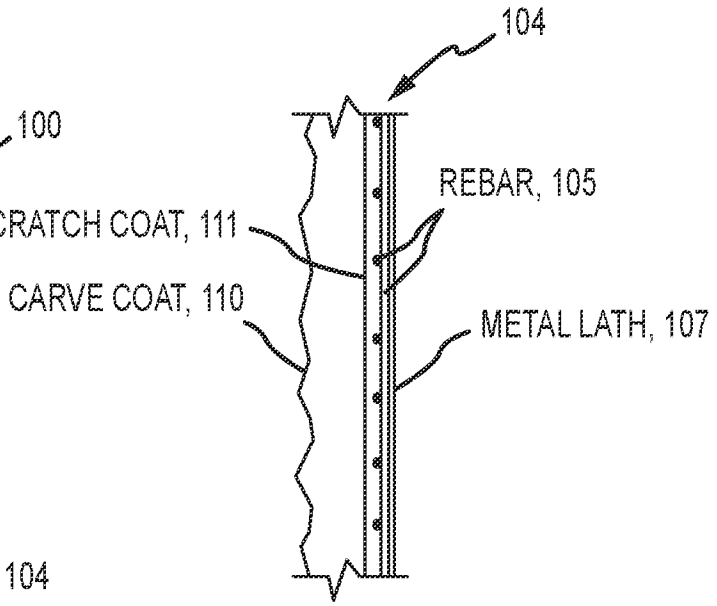
FIGS. 1A and 1B illustrate a front view and a partial sectional view showing further detail of a rockwork or physical structure fabricated according to methods taught in the present description.
Figure 1A:
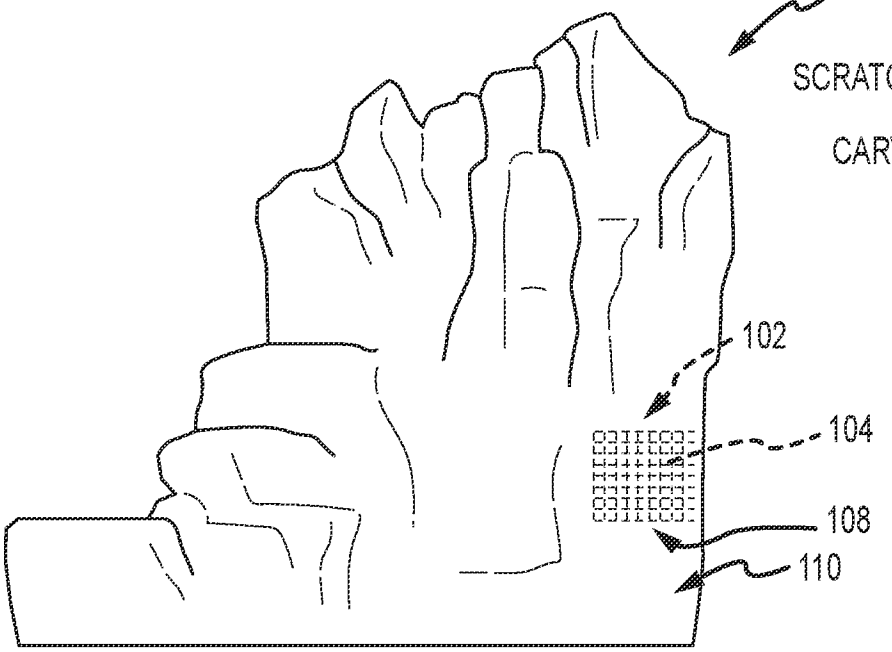

FIG. 1A illustrates an exemplary rockwork (or physical structure) 100 that may be fabricated using the mechanical join techniques of the present description. As shown, the rockwork 100 is designed to replicate a rocky hillside or cliff as may be found in nature and that may be desirable for a backdrop of a theme park ride or attraction. The rockwork 100 is formed in part with an underlying support system or network that includes numerous rebar assemblies or chips that are joined together. For example, this system or network may include the two adjacent or side-by-side chips 102 and 104 shown, and the system or network would be covered by a layer of material shown with outer coat 110 to provide the look and texture of natural rockwork (or fictional rockwork in some cases).

As discussed in greater detail, the two adjacent chips 102 and 104 are mechanically interconnected or coupled along a seam 108 where a border bar of each chip 102, 104 is in abutting contact. As will be appreciated, the rockwork 100 may include tens to hundreds (or more) of the chips 102, 104 to provide the underlying support system or network for the material layer 110, and, as a result, use of mechanical join hardware or crimps in the place of welding produces many advantages including improved safety, reduced labor, and significantly reduced timelines to fabricate the rockwork 100.

FIG. 1B is a sectional view of the rockwork showing details at the chip 104. As shown, the chip 104 includes a plurality of pieces or lengths of rebar 105 arranged in a crisscross pattern to form a rebar mesh. For example, the chip 104 may be relatively large such as 5 to 8 feet on a side, with 7-foot sides used in some implementations of the rockwork 100, and with infill bars provided at 6-inch offsets in each direction (vertical and horizontal) extending between exterior border bars. The rebar pieces 105 may be physically interconnected such as via welding at intersection points and may be individually bent to provide a desired shape to the chip 104 (e.g., the chip 104 often will not be planar as shown in FIG. 1B). A metal lath 107 may be affixed to the back or interior side of the rebar pieces 105 to complete the chip 104. To fabricate the rockwork 100, an outer layer of material or carve coat 110 may be applied to the chip 104, such as upon an initial layer of or scratch coat 111 provided as a base or coupling layer to the rebar 105. These two layers 110, 111 may be formed of the same or differing materials such as differing mixes of plaster, cement, concrete, foam, shotcrete, or the like, and the outer carve coat 110 may be sculpted or otherwise manipulated (such as with one or more layers of paint) to provide a desired outer shape, texture, and look for the rockwork 100.

In brief, the new join hardware or "crimp" was created to facilitate or enable connecting non-planar structures, such as the chips 102 and 104 of FIG. 1A, together without welding. Particularly, the use of crimps in place of welds simplifies the chip-to-chip connection process for a support system or network used in fabricating rockwork, which can be readily extended to other structures making use of rebar. To this end, custom designed crimps, which may be made of carbon steel, stainless steel, or galvanized steel, are used to fasten the two border bars together, thereby eliminating the need for welding. With the two border bars received in a crimp, a deforming or deformation force is applied to the arms of the crimp to deform the crimp via plastic deformation so as to hold the two bars in abutting contact. The deformation force may be applied by a handheld tool such as a crimper gun, e.g., a standard hydraulic crimper (such as a BURNDY® Patriot C-Head Battery Crimper that may be self-contained and hydraulic) that is able to provide a deforming force in the range of 6 to 12 tons. After deformation of the crimp from a first configuration for receiving the bars to a second configuration in which the bars are enclosed and mated together, the crimp restrains or even prevents side-to-side and longitudinal (or sliding) movements of the bars (e.g., a single crimp may provide the joint strength of 1 to 3 or more welds that typically were provided as 2-inch welds every 6 inches along the seam/joint between two adjacent chips).

Figure 2:
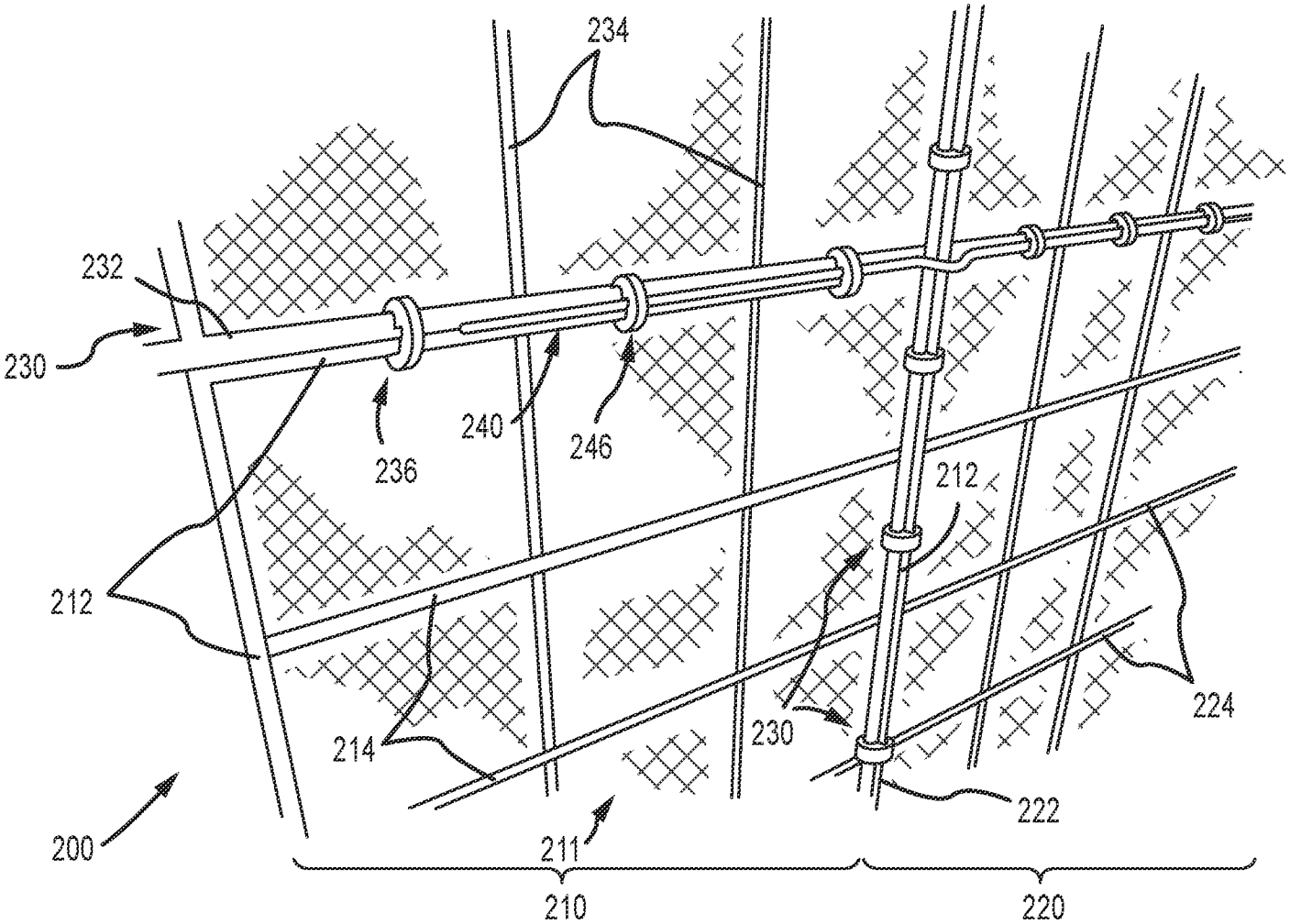
FIG. 2 illustrates a portion of a structural support system or network showing use of mechanical joining and reinforcing to interconnect or couple adjacent pairs of rebar assemblies or chips.

FIG. 2 illustrates a portion of a structural support system or network 200 showing use of mechanical joining and reinforcing to interconnect or couple adjacent pairs of rebar assemblies or chips. Specifically, the support system 200 shown includes at least three chips 210, 220, and 230 that are physically coupled or joined together using the new crimp design described herein. Each chip 210, 220, and 230 includes rebar about its periphery or edge to define its outer sides or borders, and these are shown with border bars 212, 222, and 232, respectively. The border bars 212, 222, 232 can be a relatively strong rebar such as #2 to #4 rebar with #3 rebar (i.e., 0.375-inch outer diameter (OD) rods) used in some embodiments of the support system 200, with smooth rebar shown but it being understood that conventional deformed exterior surface rebar may be used. The rebar may be formed of steel, which optionally is selected not only for strength but for corrosion resistance as is known in the arts such as treated carbon steel, stainless steel, or the like.

Extending between the border bars 212, 222, 232 are additional pieces of rebar, which may be the same as the border bars 212, 222, 232 or a smaller OD rebar such as #2 or #3 rebar (or smaller OD rebar), and these are shown with crisscrossing and offset infill bars 214, 224, and 234 (which may be offset at a variety of distances such as in the range of 4 to 10 inches with 6-inch offsets used in some implementations of system 200). Welding may be used to join the border bars 212, 222, 232 at the corners of each chip 210, 220, 230, to join the infill bars 214, 224, 234 to each other and to the border bars 212, 222, 232. A metal mesh or lath 216 may be applied to the rebar on a back or interior side of the chips 210, 220, 230.

Instead of using welding, the chips 210, 220, and 230 are joined together using a plurality of crimps, such as a crimp every 12 to 24 inches along seams between adjacent pairs of chips (in contrast to much more numerous welds that may be provided every 6 inches or the like). The mechanical coupling of chips is shown in FIG. 2 with mating border bars 212 and 222 of chips 210 and 220 being joined or held together, in abutting contact, with crimps 230. Likewise, adjacent chips 210 and 230 are joined together in part with crimp 236 mating with border bars 212 and 232. Crimps 230 and 236, as discussed in more detail below, may take the form of 2-bar crimps configured to join two pieces of rebar together that typically will have the same OD. Each crimp 230 and 236 is deformed, via plastic deformation, after the two bars 212, 222 or 212, 232 are received within their bodies within recessed surfaces such that arms extending from the crimp bodies extend at least partially around each bar 212, 222 or 212, 232 to hold the bars 212, 222 or 212, 232 in abutting contact. The plastic deformation is provided in some cases using a handheld tool (or other tool useful for onsite work) such as a hydraulic crimper or crimping gun.

Further, a reinforcing piece of rebar (or "reinforcing bar" or "crossbar") may be provided in the system 200 at one or more of the joints or seams between two adjacent chips. This is shown in FIG. 2 with a reinforcing bar 240 being coupled to abutting border bars 212 and 232 of chips 210 and 230 with crimp(s) 246. The crimp 246, hence, differs from crimps 230 in that it is configured to join three bars together or is a 3-bar crimp, which is described in detail below. The reinforcing bar 240 may have the same OD as the border bars 212 and 232 (e.g., all may be #3 rebar) or the OD may differ (e.g., be larger or smaller than the border bars), and the crimp 246 is chosen to suit the ODs of these three pieces of rebar 212, 232, and 240 (e.g., with recessed surfaces sized and shaped to receive three bars with their ODs).

The system or network 200 is useful for illustrating typical joins that may be performed onsite (such as in the field as part of a rockwork construction) using one or more crimp designs. While not limiting, it may be useful to note that the inventors have designed crimps to handle the following join situations: (a) border-to-border bar (e.g., #3 rebar to #3 rebar) with a 2-bar crimp with recessed surfaces configured for matching ODs; (b) a crossbar to two border bars (e.g., #3 rebar to #3 rebar to #3 rebar) with a 3-bar crimp configured for matching or differing ODs; (c) an infill bar to a crossbar (e.g., #2 infill rebar to #3 rebar) with a 2-bar crimp with recessed surfaces configured for differing ODs; and (d) a three bar connection (e.g., #2 infill bar to #3 added bar to #3 crossbar) with 3-bar crimp configured for at least two differing ODs.

FIGS. 3A-3D are a perspective view, a side view, and an end view of a 2-bar crimp prior to deformation or "crimping" and a side view of the 2-bar crimp during deformation or crimping to couple or fasten together two rods or pieces of rebar. More specifically, FIGS. 3A-3D illustrate a 2-bar crimp that is configured for joining together two rods or pieces of rebar, arranged to extend parallel and to be in abutting contact. The crimp 300 includes a body 312 from which two spaced-apart arms or extension members 320, 322 extend. A pair of side-by-side recessed surfaces 314, 316 are provided in the interior of the body 312 and are partially enclosed by the arms 320, 322, which extend away from the body 312 to outer edges or tips 321, 323.

The body 312 and arms 320, 322 may be sized and be formed of a metal chosen for its strength and ability to be plastically deformed without breaking. For example, the metal may be a carbon steel, which may be treated to provide corrosion resistance (e.g., galvanized or zinc plated or the like) and/or to have a particular hardness. Through testing, it has been determined that it is desirable to use steel with a hardness within ranges that allow the crimp 300 to be deformed with deforming forces in the range of 6 to 12 tons (e.g., by a 10 to 12-ton hydraulic crimper in some preferred embodiments). In some cases, a carbon steel (such as 1018 steel) is used that is annealed or otherwise treated to reduce its hardness to be below 75 HRB such as in the range of 60 to about 75 HRB with the range of about 68 to about 71 HRB being proven to be useful in the prototypes. In other cases, stainless steel (SS) may be used to provided the desired strength and hardness (deformability) characteristics, such as 304 SS or the like.

The body 312 may have a width, $W_C$, chosen to provide adequate strength and contact (restraining) area between the crimped body 312 and the received rebar, such as in the range of 0.25 to 0.5 inches with 0.375 inches used in some cases. Likewise, the height, $H_C$, of the body 312 is chosen to provide arms 320, 322 that are adequately long to wrap around and at least partially enclose upon crimping upon received rebar, such as in the range of 0.5 to 1.5 inches with about 0.75 inches used in some crimps 300. The recessed surfaces 314, 316 may have matching or differing inner radii prior to crimping to be able to fully receive and mate with (abuttingly contact) receive rebar. Hence, the inner radius, $R_I$, may be chosen to be a small amount larger than the rebar's OD for each surface 314, 316 such as about 0.26 to 0.29 inches for 0.25-inch OD rods (or #2 rebar), about 0.377 to 0.382 inches for 0.375-inch OD rods (or #3 rebar), and so on. The outer diameter, $R_O$, of the arms 320, 322 is chosen to provide an arm thickness that can be deformed and that will have adequate strength after plastic deformation to retain received rebar, such as in the range of 0.3 to about 0.5 inches with about 0.37 inches used in one implementation utilizing 1018 steel annealed to 68 to 71 HRB (e.g., 69 HRB plus or minus 1 HRB), with the hardness chosen to ensure the crimper (e.g., 12-ton crimper) can compress the material of the crimp 300 tightly against received rods/pieces of rebar.

Figure 3A:
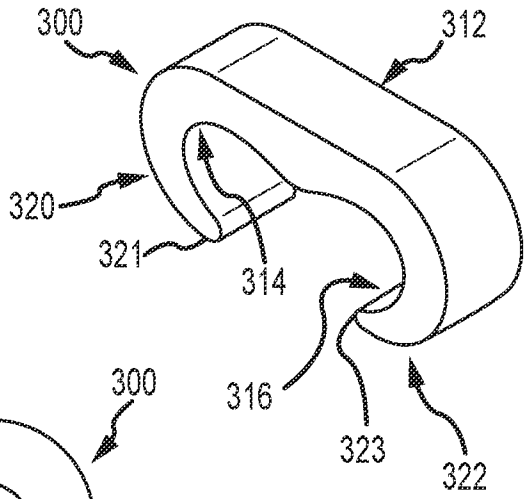
FIGS. 3A-3D are a perspective, side, and end view of a 2-bar crimp prior to deformation or "crimping" (or in a first or nondeformed configuration) and a side view of the 2-bar crimp during deformation or crimping to couple or fasten together two rods or pieces of rebar (to place the crimp in a second or deformed configuration)
Figure 3B:
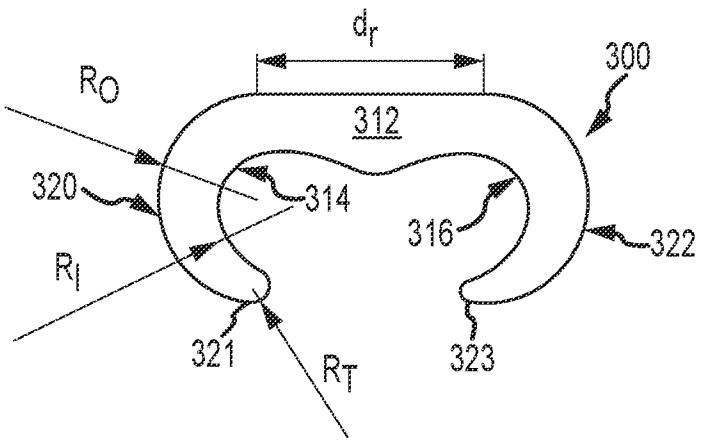
Figure 3C:
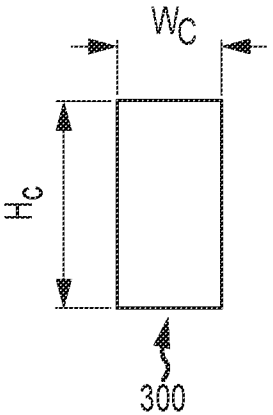
Figure 3D:
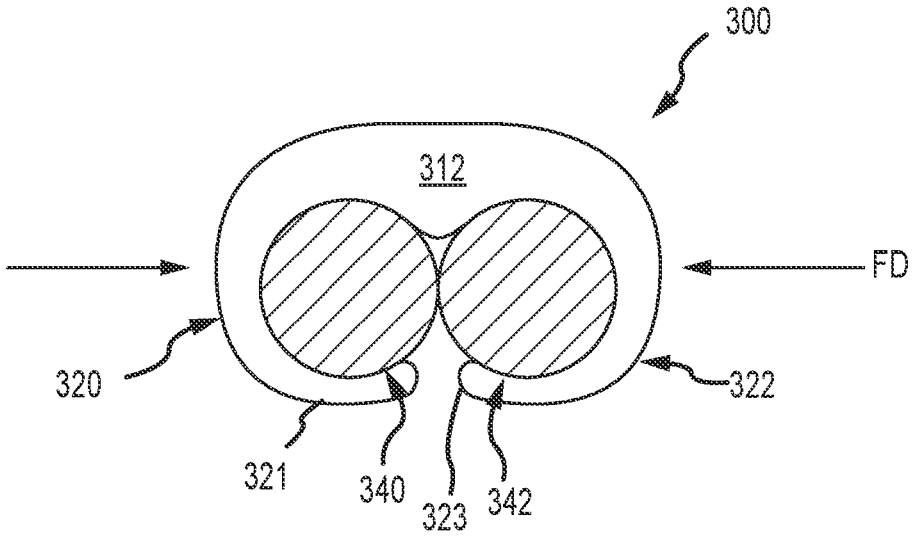

FIG. 3D illustrates the crimp 300 in use to join to pieces of rebar 340, 342. As shown, the rebar (e.g., border bars) 340, 342 has the same OD, but other crimps are configured for two differing ODs. Each border bar 340 and 342 is received within the interior space of the body 312 to be in abutting contact with a recessed surface 314 or 316, and the bars 340, 342 are parallel to each other. A deforming force, FD, is applied, such as with a hydraulic crimper providing a force of up to about 12 tons, to the outer surfaces of the arms 320, 322 causing the arms to be moved together or be crimped together. This results in the tips 321 and 323 of the arms 320, 322 to contact each other or to be spaced apart by a distance that is less than an OD of either of the rods/bars 340, 342. Also, the two rods/bars 340, 342 are forced into, and then held in, abutting contact within the body 312 by the deformation provided by application of the deforming force, FD. Once this abutting contact is achieved and the crimp 300 is deformed from a first configuration (shown in FIGS. 3A-3C) to a second configuration (shown in FIG. 3D), the deforming force, FD, can be removed, and the crimp 300 will mechanically hold the two bars 340, 342 together.

Figure 4A:
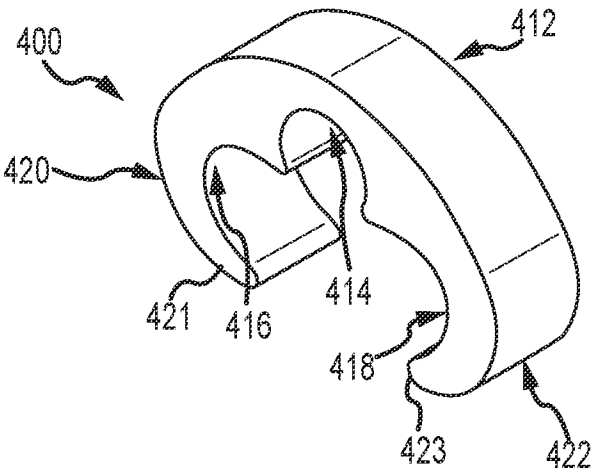
FIGS. 4A-4C are a perspective, side, and end view of a 3-bar crimp prior to deformation or "crimping"
Figure 4B:
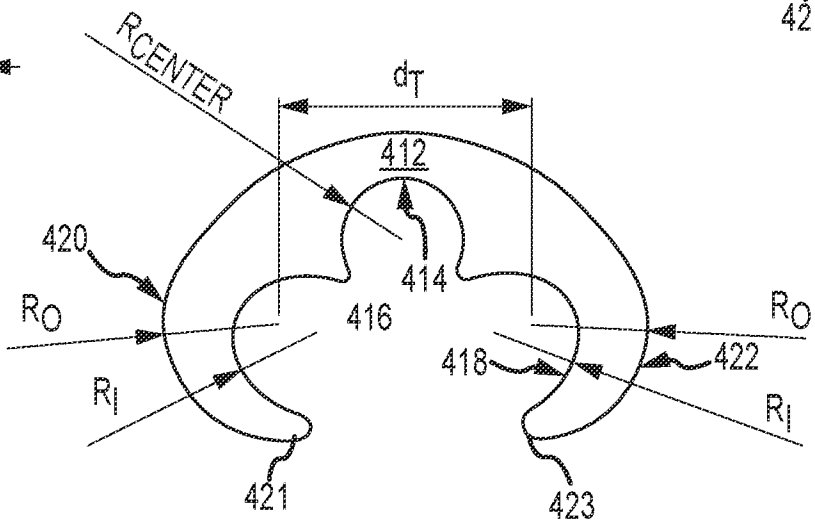
Figure 4C:
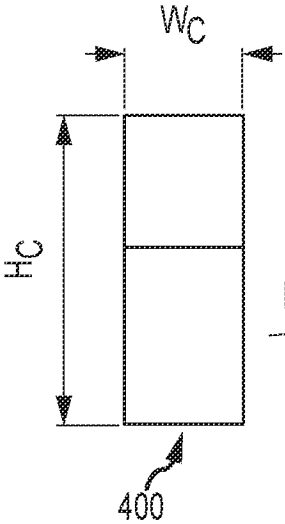

FIGS. 4A-4C illustrate another embodiment of a crimp 400 in its first or nondeformed configuration. The crimp 400 is a 3-rod crimp configured for joining together three rods or pieces of rebar. In the illustrated example, the crimp 400 is configured for receiving and joining three rods or pieces of rebar with equal ODs (e.g., three pieces of #2 or #3 rebar), but other implementations will be configured with recessed surfaces adapted for receiving rods/bars of two or three differing ODs. More specifically, FIGS. 4A-4C illustrate a 3-bar crimp that is configured for joining together three rods or pieces of rebar, arranged to extend parallel and to be in abutting contact. The crimp 400 includes a body 412 from which two spaced-apart arms or extension members 420, 422 extend. Three side-by-side recessed surfaces 414, 416, and 418 are provided in the interior of the body 412 and are partially enclosed by the arms 420, 422, which extend away from the body 412 to outer edges or tips 421, 423.

The body 412 and arms 420, 422 may be sized and be formed of a metal chosen for its strength and ability to be plastically deformed without breaking. For example, the metal may be a stainless steel (SS) to have a particular hardness such as 90 HRB or less. Through testing, it has been determined that it is desirable to use SS, such as 304 SS or another SS type, with a hardness within ranges that allow the crimp 400 to be deformed with deforming forces in the range of 6 to 12 tons (e.g., by a 10 to 12-ton hydraulic crimper and with a 12-ton crimper used in some preferred embodiments). In other cases, a carbon steel may be used as discussed for crimp 300.

The body 412 may have a width, $W_C$, chosen to provide adequate strength and contact (restraining) area between the crimped body 412 and the received rebar, such as in the range of 0.25 to 0.5 inches with 0.375 inches used in some cases. Likewise, the height, $H_C$, of the body 412 is chosen to provide arms 420, 422 that are adequately long to wrap around and at least partially enclose upon crimping upon received rebar, such as in the range of 0.5 to 1.5 inches with about 1.0 inches used in some crimps 400. The recessed surfaces 414, 416, and 418 may have matching or differing inner radii prior to crimping to be able to fully receive and mate with (abuttingly contact) receive rebar. Hence, the inner radii, $R_I$ and $R_{Center}$ (with RI used for surface 416 and 418) may be chosen to be a small amount larger than the rebar's OD for each surface 414, 416, and 418 such as about 0.26 to 0.29 inches for 0.25-inch OD rods (or #2 rebar), about 0.377 to 0.382 inches for 0.375-inch OD rods (or #3 rebar), and so on. The outer diameter, $R_O$, of the arms 420, 422 is chosen to provide an arm thickness that can be deformed and that will have adequate strength after plastic deformation to retain received rebar, such as in the range of 0.3 to about 0.5 inches with about 0.37 inches used in one implementation utilizing 304 SS (e.g., 1-inch by 0.5-inch bar material). As with the crimp 300 shown in FIG. 4D, the crimp 400 would be deformed after receiving in the body 412 three pieces of rebar within surfaces 414, 416, 418 by applying a deforming force on the outer surfaces of arms 420 and 422 until all three pieces of rebar are in abutting contact and arm tips 421 and 423 are in contact or nearly so (e.g., spaced apart by a distance less than a smallest OD of the three received rods/pieces of rebar).

Figure 5:
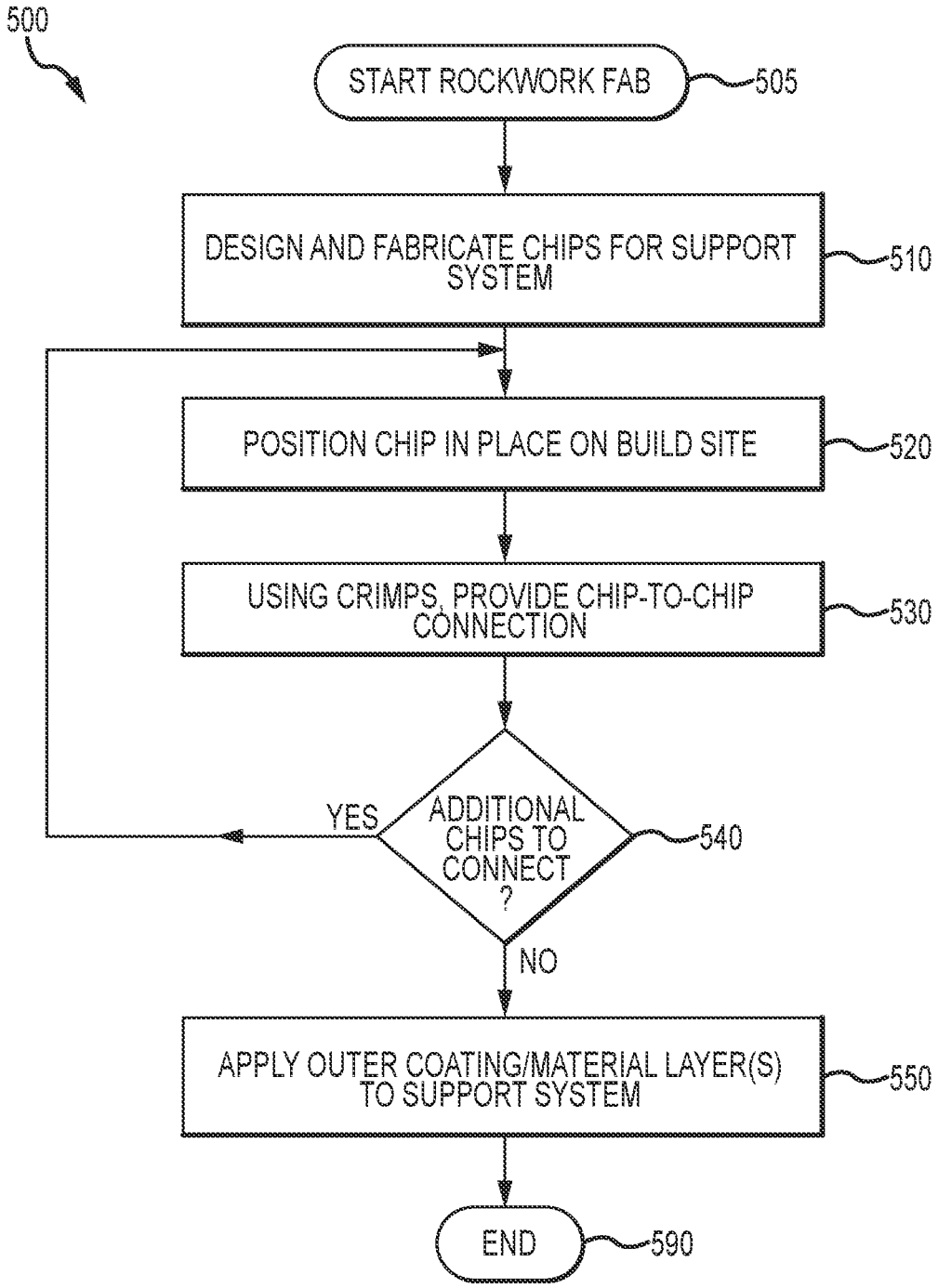
FIG. 5 illustrates a flow diagram for a physical structure fabrication process using the crimps of the present description for chip-to-chip connections.

FIG. 5 illustrates a flow diagram for a physical structure fabrication process 500 using the crimps of the present description for chip-to-chip (or rebar assembly-to-rebar assembly) connections. The method 500 starts at 505 with a physical structure such as rockwork being initiated for a particular build site such as for an attraction at a theme park or the like. Step 505 may include designing the exterior shape, texture, and look and feel for the physical structure. The method 500 continues at 510 with designing the support system for the physical structure including dividing this support system into a plurality of rebar panels/assemblies or chips. Step 510 also includes fabricating each chip for the support system, and each chip typically will include a periphery or outer edge made up of border bars (e.g., #3 rebar arranged generally in a rectangle or square) and in interior mesh made up of a plurality of crisscrossing infill bars (e.g., #2 rebar extending vertically and horizontally at 6-inch or other offsets). The infill and/or border bars may be bent prior to assembly into a chip to provide a desired nonplanar shape suited for a particular portion of the rockwork or physical structure (e.g., each chip may be planar or nonplanar).

The method 500 continues at 520 with positioning a chip in place on the build side (e.g., at its predefined location in support system being built). Then, in step 530, the positioned chip is connected to any adjacent chips using the crimps described herein. This may involve using a number of 2-bar crimps to couple the border bars of adjacent chips along a seam or joint (such as with a crimp provided every 12 to 24 inches along the length of the seam/joint). Step 530 may involve positioning a crimp concurrently over two border bars so that both bars are received within the recessed surfaces of the 2-bar crimp and then applying a deforming force, such as with a hydraulic crimper, to deform the 2-bar crimp and to couple the two parallel border bars together in abutting contact within the body of the 2-bar crimp. Step 530 may also include applying a crossbar or reinforcing piece of rebar along the chip-to-chip joint/seam, and this may involve positioning the crossbar parallel to two border bars and placing a 3-bar crimp over the three pieces of rebar such that they are received within the recessed surfaces of the 3-bar crimp. Then, a deforming force is applied, again typically with a crimping tool, to deform the arms of the 3-bar crimp to force the three bars into contact within the body of the crimp.

The method 500 continues at 540 with determining whether there are additional chips to be installed or connected within the support system. If yes, the method 500 continues with repeating steps 520 and 530. In some embodiments, step 520 is repeated until all chips or a subset of all of the chips are in position prior to repeating step 530 and 540 until all chip-to-chip connections are completed. The method 500 continues to step 550 when all chips are positioned and connected together and reinforces using the crimps of the present description. At step 550, the rockwork or physical structure is completed by applying and finishing one or more outer layers of material upon the support system of chips. This may involve applying plaster or the like to the rebar chips and then sculpting and finishing (e.g., painting) the outer surface of this applied layer. Once this outer layer is completed, the method 500 may end at step 590.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

For example, the exemplary figures illustrate the crimps being used for bar-to-bar attachment, but, with the teaching provided herein, it will be understood by those skilled in the art that the crimps may be adapted for other uses. Particularly, the crimps may be used attaching fiber optics to rebar in some cases while other uses of the crimps may be for mounting speaker boxes to rebar. Lightening rods may also be attached to chips shown herein using a lightening bar to rebar(s) crimp connection. Other elements, e.g., nearly any nonstructural component, may be attached to one or more of the chips by placing a portion of the element in the crimp with one or two pieces of rebar.

We claim:

1. An underlying structural support system for use in fabricating a physical structure, comprising:

a plurality of rebar assemblies, wherein each of the rebar assemblies comprises a first set of pieces of rebar extending about an exterior border and a second set of pieces of rebar arranged in a crisscross pattern to infill a space within the exterior border; and a plurality of two-bar crimps interconnecting adjacent pairs of the plurality of rebar assemblies, wherein each of the two-bar crimps receives a piece of rebar from the first set of pieces of rebar from each of the adjacent pairs and retains the two received pieces of rebar in abutting contact, wherein each of the two-bar crimps comprises a body with a pair of recessed surfaces configured for receiving the two received pieces of rebar and with a pair of spaced apart arms encircling the two received pieces of rebar, and wherein the body is reconfigurable via plastic deformation under a deforming force from a first configuration, in which tips of the spaced apart arms define an opening greater than an outer diameter of each of the two received pieces of rebar to provide access to the pair of recessed surfaces, to a second configuration, in which the opening is less than the outer diameter of each of the two received pieces of rebar.

2. The support system of claim 1, wherein the deforming force is in the range of 6 to 12 tons and the body is formed of a steel.

3. The support system of claim 2, wherein the steel is carbon steel with a hardness in the range of 60 to 75 HRB.

4. The support system of claim 2, wherein the steel is a stainless steel with a hardness less than about 90 HRB.

5. The support system of claim 1, further comprising a plurality of reinforcing bars and a plurality of three-bar crimps mechanically coupling the reinforcing bars to the first set of pieces of rebar of the adjacent pairs of the plurality of rebar assemblies.

6. The support system of claim 5, wherein each three-bar crimp of the plurality of three-bar crimps comprises a body with three recessed surfaces configured for receiving one of the reinforcing bars and two pieces of rebar from the first set of pieces of rebar of the adjacent pairs of the plurality of rebar assemblies and with a pair of spaced apart arms encircling the one of the reinforcing bars and the two pieces of the rebar.

7. The support system of claim 6, wherein the body of the three-bar crimp is reconfigurable via plastic deformation under a deforming force from a first configuration, in which tips of the spaced apart arms define an opening greater than an outer diameter of each of one of the reinforcing bars and the two pieces of the rebar to provide access to the recessed surfaces, to a second configuration, in which the opening is reduced in size and the one of the reinforcing bars and the two pieces of the rebar are retained in abutting contact.

8. The support system of claim 7, wherein the deforming force is in the range of 6 to 12 tons and the body is formed of a carbon steel in the range of 60 to 75 HRB or of a stainless steel with a hardness less than about 90 HRB.

9. An underlying structural support system for use in fabricating a physical structure, comprising:

a plurality of rebar assemblies, wherein each of the rebar assemblies comprises a first set of pieces of rebar extending about an exterior border and a second set of pieces of rebar arranged in a crisscross pattern to infill a space within the exterior border;

a plurality of two-bar crimps interconnecting adjacent pairs of the plurality of the rebar assemblies, wherein each of the two-bar crimps receives a piece of rebar from the first set of pieces of rebar from each of the adjacent pairs and retains the two received pieces of rebar in abutting contact; and a plurality of reinforcing bars and a plurality of three-bar crimps mechanically coupling the reinforcing bars to the first set of pieces of rebar of the adjacent pairs of the plurality of rebar assemblies.

10. A method of fabricating an underlying support structure for use in a physical structure, comprising:

positioning a first rebar panel in a first predefined position of the support structure;

positioning a second rebar panel in a second predefined position of the support structure, wherein each of the first and second rebar panels comprises a first set of pieces of rebar extending about an exterior border and a second set of pieces of rebar arranged in a crisscross pattern to infill a space within the exterior border and wherein a pair of the first set of pieces of the rebar from the first and second rebar assemblies are adjacent and parallel; and physically coupling the pair of the first set of pieces of the rebar together by positioning crimps over the pair of the first set of pieces of the rebar and applying a deforming force to each crimp to plastically deform the crimp from a first configuration to a second configuration, wherein each of the crimps comprises a body with a pair of recessed surfaces configured for receiving the pair of the first set of pieces of the rebar and with a pair of spaced apart arms encircling the two received pieces of rebar and wherein, in the first configuration, tips of the spaced apart arms define an opening greater than an outer diameter of each of the pair of the first set of pieces of the rebar to provide access to the pair of recessed surfaces and, in the second configuration, the opening is less than the outer diameter of each of the pair of the first set of pieces of the rebar.

11. The method of claim 10, wherein the deforming force is in the range of 6 to 12 tons.

12. The method of claim 11, wherein the body is formed of carbon steel with a hardness in the range of 60 to 75 HRB or a stainless steel with a hardness less than about 90 HRB.

13. The method of claim 10, further comprising coupling a reinforcing bar to the pair of the first set of pieces of the rebar by positioning a three-bar crimp over the pair of the first set of pieces of the rebar and the reinforcing bar and applying a deforming force to the three-bar crimp to plastically deform the three-bar crimp from a first configuration to a second configuration.

14. The method of claim 13, wherein the three-bar crimp comprises a body with three recessed surfaces configured for receiving the reinforcing bar and the pair of the first set of pieces of the rebar and with a pair of spaced apart arms encircling the reinforcing bar and the pair of the first set of pieces of the rebar.

15. A method of fabricating an underlying support structure for use in a physical structure, comprising:

positioning a first rebar panel in a first predefined position of the support structure;

positioning a second rebar panel in a second predefined position of the support structure, wherein each of the first and second rebar panels comprises a first set of pieces of rebar extending about an exterior border and a second set of pieces of rebar arranged in a crisscross pattern to infill a space within the exterior border and wherein a pair of the first set of pieces of the rebar from the first and second rebar assemblies are adjacent and parallel;

physically coupling the pair of the first set of pieces of the rebar together by positioning crimps over the pair of the first set of pieces of the rebar and applying a deforming force to each crimp to plastically deform the crimp from a first configuration to a second configuration; and coupling a reinforcing bar to the pair of the first set of pieces of the rebar by positioning a plurality of three-bar crimps over the pair of the first set of pieces of the rebar and the reinforcing bar and applying a deforming force to each three-bar crimp to plastically deform each three-bar crimp from a first configuration to a second configuration.

* * * * *